US008388407B1

(12) United States Patent
Champaigne

(10) Patent No.: US 8,388,407 B1
(45) Date of Patent: Mar. 5, 2013

(54) APPARATUS FOR TREATING A WORKPIECE WITH A GRANULAR MEDIA

(75) Inventor: Jack Champaigne, Mishawaka, IN (US)

(73) Assignee: Electronics Inc., Mishawaka, IN (US)

( * ) Notice: Subject to any disclaimer, the term of this patent is extended or adjusted under 35 U.S.C. 154(b) by 697 days.

(21) Appl. No.: 12/620,853

(22) Filed: Nov. 18, 2009

Related U.S. Application Data

(60) Provisional application No. 61/203,021, filed on Dec. 18, 2008.

(51) Int. Cl.
*B24C 7/00* (2006.01)

(52) U.S. Cl. ..... 451/2; 451/99

(58) Field of Classification Search ..... 451/75, 451/99, 101, 38, 39, 40, 2
See application file for complete search history.

(56) References Cited

U.S. PATENT DOCUMENTS 2,899,981 A * 8/1959 Binks ..... 138/46
4,089,348 A * 5/1978 Yoshida et al. ..... 137/856
4,693,102 A * 9/1987 Amy et al. ..... 72/53
4,873,855 A * 10/1989 Thompson ..... 72/53

* cited by examiner

*Primary Examiner* — Robert Rose
(74) *Attorney, Agent, or Firm* — Botkin & Hall, LLP

(57) ABSTRACT

An apparatus for treating a workpiece with a granular media includes a hopper for storing media and discharging the media into a flow path. A source of compressed air mixes with the media, which is forced through a nozzle for directing media onto the workpiece. A flow sensor includes a beam extending into the flow path and is responsive to flow of media in the flow path to increase and decrease deflection of the beam in response to increasing or decreasing flow of media through said flow path. A proximity sensing device measures deflection of the beam and generates an electrical signal which varies in response to deflection of the beam. The flow path is defined by a conduit having a branch in which the beam is mounted. One end of the beam is mounted on a base in the branch. The base is mounted on a cap closing an open end of the branch, permitting the beam to be easily removed and changed when necessary.

13 Claims, 3 Drawing Sheets

APPARATUS FOR TREATING A WORKPIECE WITH A GRANULAR MEDIA

CROSS REFERENCE TO RELATED APPLICATIONS

This application claims the benefit of U.S. Provisional Application No. 61/203,021, filed Dec. 18, 2008, the disclosure of which is hereby incorporated by reference.

TECHNICAL FIELD

This invention relates to a device for measuring flow of granular media and an apparatus for treating a workpiece with granular media.

BACKGROUND OF THE INVENTION

Treatment of a workpiece with granular media, such as in abrasive blast cleaning and in shot peening, has become relatively common. The flow rate of the granular media in these applications is often set by a fixed orifice or sometimes by a mechanical or electrical valve; however, the actual flow rate is not commonly sensed. The flow rate through the flow path may vary during operation, so it is desirable to have a flow sensor measuring the actual flow rate, which can be processed and displayed to assist in effective control of the process.

Many flow sensors for such applications have been proposed, often using the reaction force of the impact of a falling stream of media onto a slanted surface. However, such flow sensors wear quickly because of the abrasive nature of the impact of the falling media. These devices often have hinges or bearings subject to contamination which affects accuracy and performance. Flow sensing devices incorporating, for example, strain gauges, bearings, or hinges require difficult and delicate procedures for maintenance. Often, delicate wiring connected to the flow sensor is broken or damaged during such maintenance procedures.

SUMMARY OF THE INVENTION

The present invention provides a simple bending beam that deflects as a function of the flow of media, and thus requires no complicated hinges, strain gages or bearings which are subject to damage during maintenance. The bending beam can be easily removed and replaced when necessary. Accordingly, an apparatus for treating a workpiece with a granular media according to the present invention includes a hopper for storing media and discharging the media into a flow path. A source of compressed air mixes with the media, which is forced through a nozzle for directing media onto the workpiece. A flow sensor includes a beam extending into the flow path and is responsive to flow of media in the flow path to increase and decrease deflection of the beam in response to increasing or decreasing flow of media through said flow path. A proximity sensing device measures deflection of the beam and generates an electrical signal which varies in response to deflection of the deflectable member. The flow path is defined by a conduit having a branch in which the beam is mounted. One end of the beam is mounted on a base in the branch. The base is mounted on a cap closing an open end of the branch, permitting the beam to be easily removed and changed when necessary.

DETAILED DESCRIPTION OF INVENTION

Figure 1:
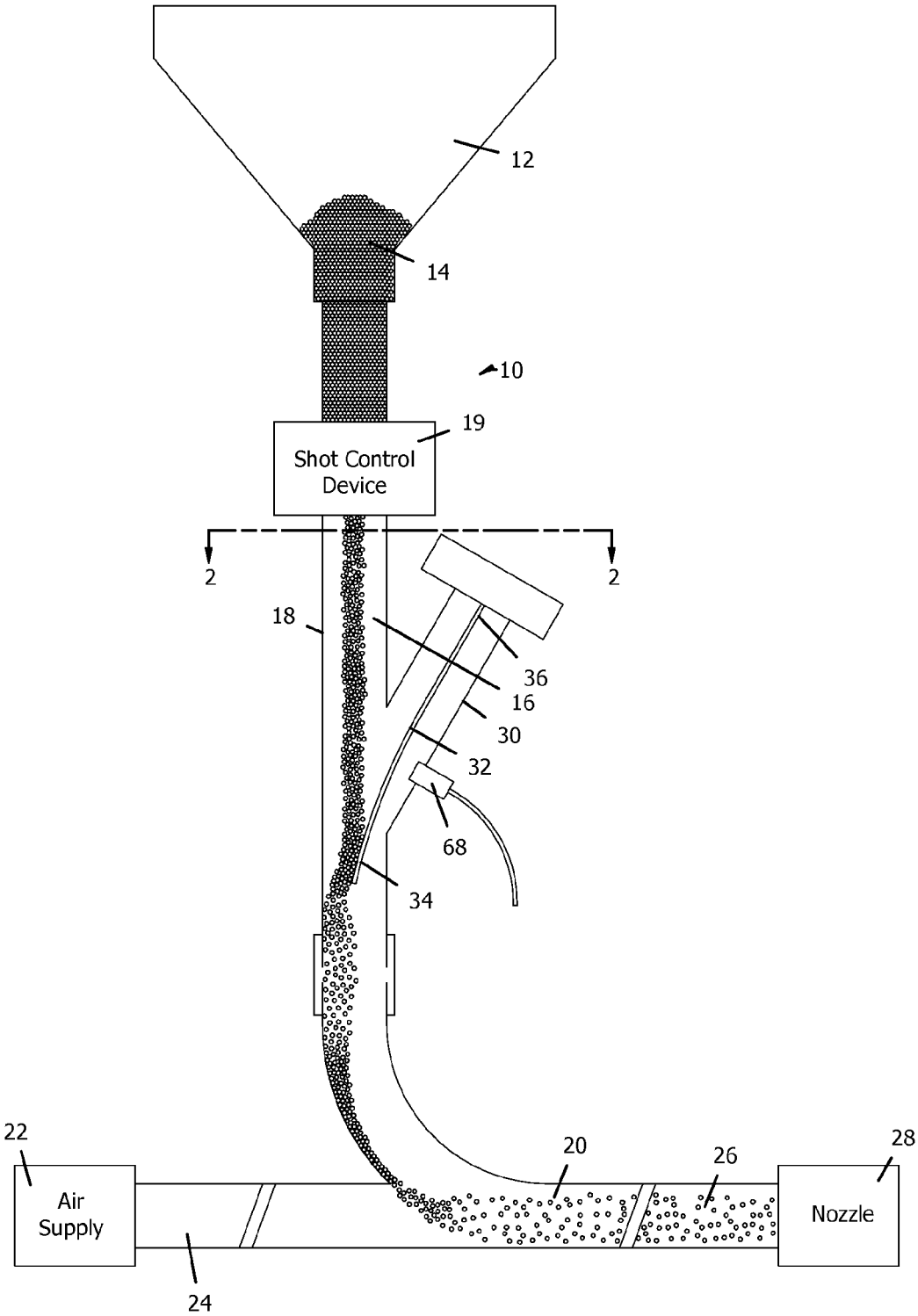
FIG. 1 is a schematic illustration of an apparatus for treating a workpiece incorporating the flow sensor of the present invention.
Figure 2:
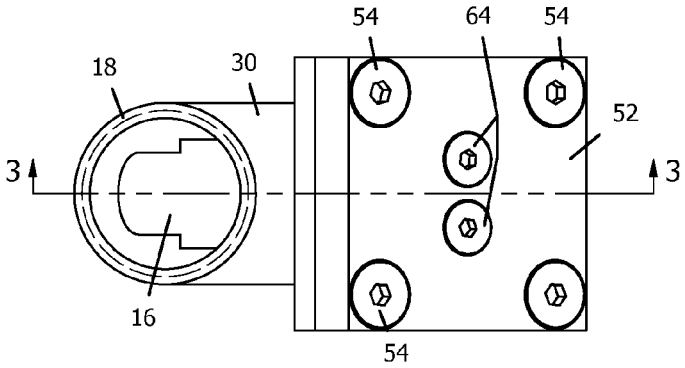
FIG. 2 is a view taken substantially along lines 2-2 of FIG. 1.

Referring now to the drawings, an apparatus for treating a workpiece, such as used in shot peening or blast cleaning operations, is illustrated schematically in FIG. 1. Apparatus 10 includes a hopper 12 which stores a granular media, such as shot, sand, or similar material, as indicated at 14. Shot 14 drops from the hopper 12 into a flow path 16 defined by a conduit within a housing 18. A shot-control device, generally indicated at 19 (which may be, for example, an orifice or a mechanically or electrically operated valve) controls dispensation of the shot 14 into the flow path 16. The flow path 16 terminates in a mixing chamber 20. A supply of compressed air, generally indicated at 22, is communicated with the mixing chamber 20 via a supply hose 24, and a blast hose 26 communicates the mixing chamber 20 to a nozzle 28, which directs the media onto the workpiece.

Figure 3:
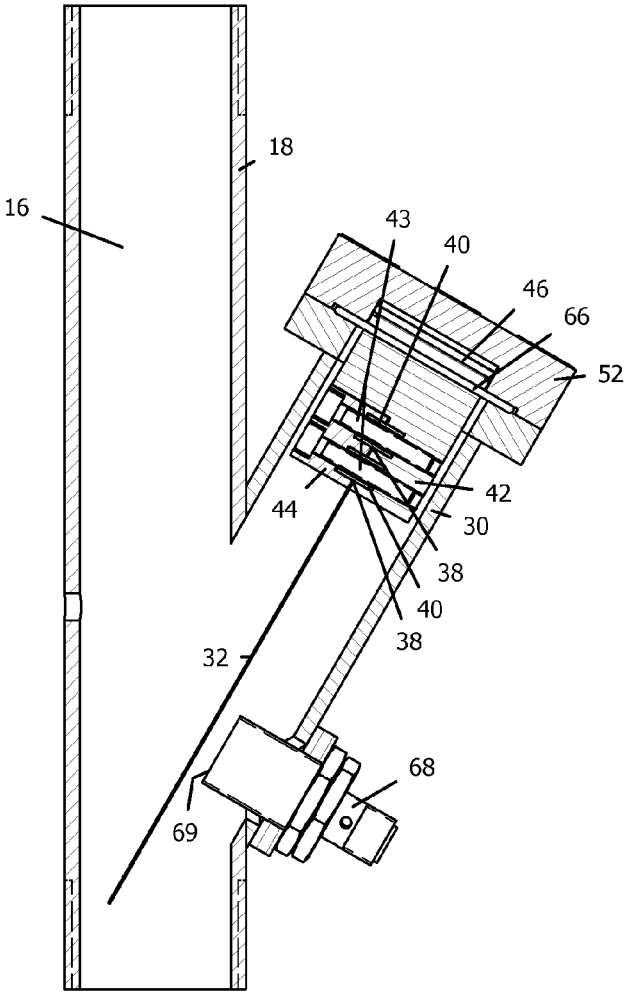
FIG. 3 is a cross-sectional view taken substantially along lines 3-3 of FIG. 2.
Figure 4:
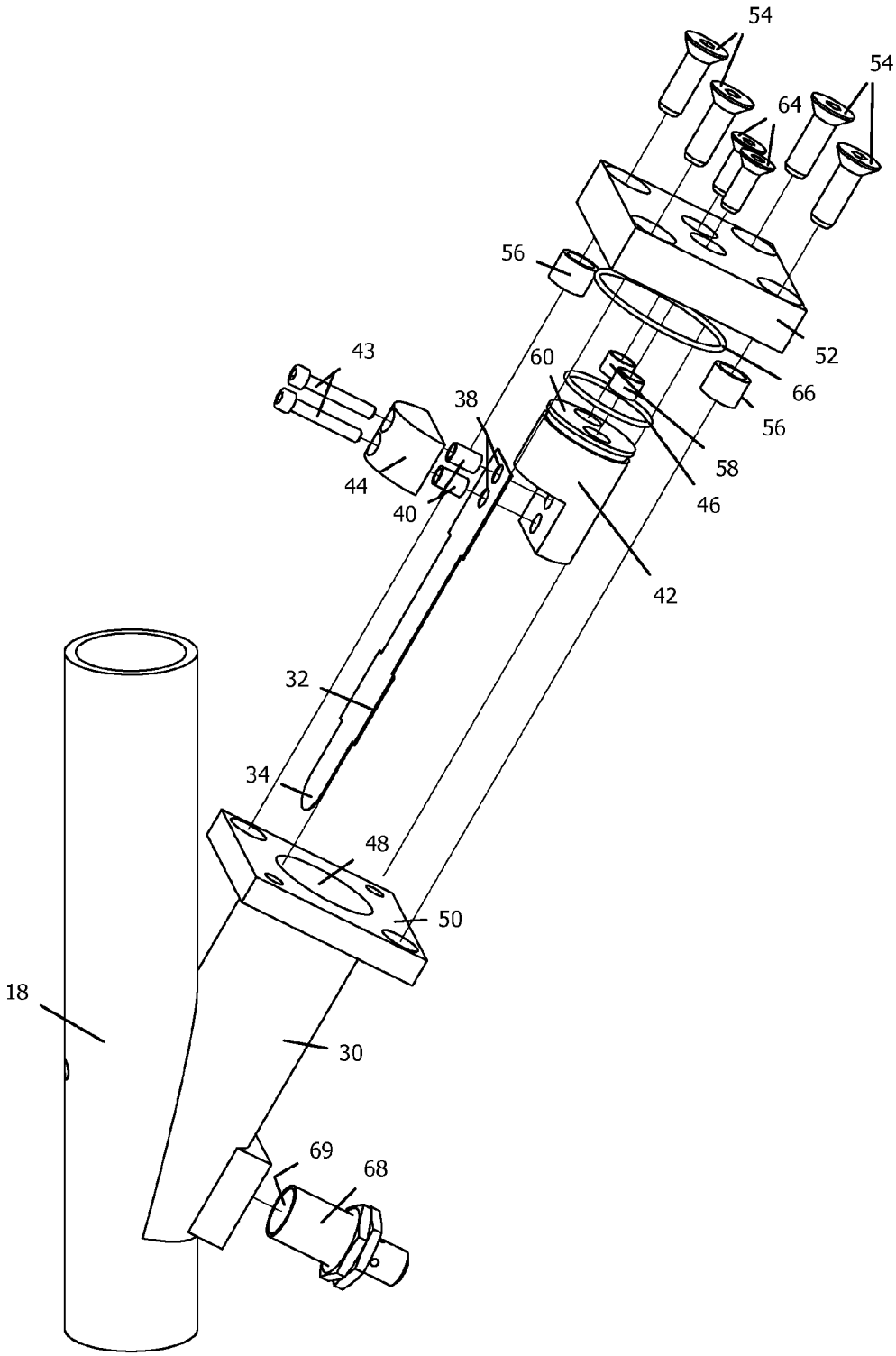
FIG. 4 is an exploded view in perspective of a housing comprising a component of the apparatus illustrated in FIGS. 1-3.

As can be seen in FIG. 1, the flow path 16 is substantially vertical, to permit the media to drop by gravity into the mixing chamber 20. Housing 18 includes a branch 30 which enters the flow path 16 at about a 60° angle. The flow sensor of the present invention includes a simple bending beam 32 which is mounted in the branch 30 as will hereinafter be described. The beam 32 is a simple bending beam and requires no bearings or hinges but is simply attached to a rigid member in the branch 30. One end 34 of the beam 32 extends into the flow path 16, where it is impacted by the falling media 14. The other end 36 of the beam 32 is provided with apertures 38 (FIGS. 3 and 4) which receive alignment pins 40 extending outwardly from a base 42 mounted in the branch 30. Screw fasteners 43 extend through corresponding apertures in a base cap 44 and through the alignment pins 40 and are threadedly engaged with base 42 to thereby secure the beam 32 through the base 42.

The branch 30 terminates in an open end 48. The open end 48 defines a flange 50 which is engaged by a cap 52. Appropriate fasteners 54 secure the cap 52 to the flange 50. Alignment pins 56 receive the fasteners 54 and orient the cap 52 relative to the flange 50. Alignment pins 58 extend from transverse surface 60 of the base 42 and receive fasteners 64 which secure the base 42 to the cap 52. An O-ring 66 provides sealing between the cap 52 and the flange 50. Accordingly, the base 42 and beam 32 are removed with the cap 52 when the latter is removed from the branch 30.

A proximity sensor 68, of conventional design, is mounted on the branch 30 and extends through the wall thereof. The end 69 of proximity sensor 68 is displaced from the beam 32 and faces the latter. Sensor 68 is a non-contact linear displacement sensor and may be, for example, an Omega part number LD701-2-5 displacement sensor. The sensor 68 responds to changes in the distance between the sensor 68 and the beam 32 to generate an electrical signal which varies as a function of the variations in the distance between the beam 32 and the end of the sensor 68.

In operation, media is dropped from the hopper 12 through the flow path 16 and into the mixing chamber 20, where it is entrained in the air stream from air supply 22, which is forced through blast hose 26 and nozzle 28 to the workpiece (not shown). The impact of the media on the portion of the beam 32 exposed to the flow of media in the flow path causes beam 32 to deflect. The deflection of the beam 32 varies as a function of the quantity of media impacting upon the beam 32. Accordingly, a greater quantity of media impacting on the beam 32, which is indicative of a higher flow rate, causes the beam 32 to deflect toward the sensor 68, while a lessening of the flow of media through the flow path 16 permits the resiliency of the beam 32 to cause the latter to deflect away from the sensor 68. The sensor 68 generates a signal which, therefore, varies as a function of the distance between the beam 32 and the sensor 68, to thereby generate a signal that is varied as a function of the flow of media through the flow path. This electrical signal can be processed in a normal manner and converted to a display to thereby indicate the actual media flow rates through the flow path 16.

Particularly in blast cleaning operations which use abrasive media, impact of the media on the beam 32 causes wear, thereby requiring service and replacement of the beam 32 at regular maintenance intervals. This can be easily effected by removing the cap 52, replacing the beam 32 by removal of the screw fasteners 43, and then installing a new beam 32. The cap 52 is then replaced on the flange 50. The base 42 and base cap 44 slidably engage the inner surface defined by the branch 30 when the base and cap are installed and removed from the branch 30, thereby properly orienting the beam 32 relative to the flow path. Accordingly, proper alignment is assured when the cap 52 is replaced on the flange 50, thereby permitting normal maintenance allowing replacement of the beam 32 to be completed quickly and easily. Accordingly, flow of media is sensed and displayed using a sensor which is a simple beam and does not require complicated bearings or strain gages requiring wiring which can be damaged during maintenance procedures. Instead, when necessary, the entire beam can be removed and replaced with minimal disruption.

This invention is not limited to the details above, but may be modified within the scope of the following claims.

What is claimed is:

1. Apparatus for treating a workpiece with a granular media comprising:
- a hopper for storing media and discharging media into a flow path;
- a source of compressed air communicating with the flow path, said flow path terminating in a nozzle for directing media onto the workpiece;
- a flow sensor including a deflectable member extending into said flow path, said deflectable member being responsive to flow of media in said flow path to increase and decrease deflection of the deflectable member in response to increasing or decreasing flow of media through said flow path; and
- a sensing device for measuring deflection of said deflectable member and generating an electrical signal which varies in response to deflection of said deflectable member.

2. Apparatus for treating a workpiece with a granular media as claimed in claim 1, wherein said sensing device is a proximity sensor displaced from said deflectable member but responsive to changes in the distance between the deflectable member and the proximity sensor to generate said electrical signal.

3. Apparatus for treating a workpiece with a granular media as claimed in claim 2, wherein said deflectable member is a beam extending into said flow path.

4. Apparatus for treating a workpiece with a granular media as claimed in claim 1, wherein said deflectable member is a beam extending into said flow path.

5. Apparatus for treating a workpiece with a granular media as claimed in claim 1, wherein said flow path is defined by a housing having an inlet communicated with said hopper and an outlet communicated with said supply hose and said blast hose, said housing including a branch defining a passage extending from said flow path, said deflectable member being mounted in said branch and projecting from said branch into said flow path, said deflectable member being responsive to flow of media in said flow path to increase and decrease deflection of the deflectable member in response to increasing or decreasing flow of media through said flow path.

6. Apparatus for treating a workpiece with a granular media as claimed in claim 5, wherein said deflectable member is a beam having opposite ends, one end of said beam extending into said flow path, the other end of the beam being secured in said passage.

7. Apparatus for treating a workpiece with a granular media as claimed in claim 6, wherein a proximity sensor is mounted in said branch displaced from said beam, said proximity sensor being responsive to changes in the distance between the deflectable member and the proximity sensor to generate said electrical signal.

8. Apparatus for treating a workpiece with a granular media as claimed in claim 6, wherein a base is mounted in said branch, said other end of said beam being secured to said base via one or more releasable fasteners.

9. Apparatus for treating a workpiece with a granular media as claimed in claim 6, wherein said branch terminates in an open end, a removable cap closing said open end, a base mounted in said branch, said other end of said beam being secured to said base via one or more releasable fasteners, said fasteners securing said base to said cap whereby said cap and said beam are removed from said branch with said cap.

10. Apparatus for treating a workpiece with a granular media comprising:
- a hopper for storing media,
- a housing defining a flow path having an inlet communicated with said hopper and communicating said hopper with the workpiece, said housing including a branch defining a passage extending from said flow path;
- a deflectable member mounted in said branch and projecting from said branch into said flow path; and
- a proximity sensor displaced from said deflectable member but responsive to changes in the distance between the deflectable member and the proximity sensor for measuring deflection of said deflectable member and generating an electrical signal which varies in response to deflection of said deflectable member.

11. Apparatus for treating a workpiece with a granular media as claimed in claim 10, wherein said deflectable member is a beam having opposite ends, one end of said beam extending into said flow path, the other end of the beam being secured in said passage.

12. Apparatus for treating a workpiece with a granular media as claimed in claim 11, wherein a base is mounted in said branch, said other end of said beam being secured to said base via one or more releasable fasteners.

13. Apparatus for treating a workpiece with a granular media as claimed in claim 10, wherein said branch terminates in an open end, a removable cap closing said open end, a base mounted in said branch, said other end of said beam being secured to said base via one or more releasable fasteners, and fasteners securing said base to said cap whereby said cap and said beam are removed from said branch with said cap.

* * * * *